US012643649B1

(12) United States Patent
Snyder et al.

(10) Patent No.: US 12,643,649 B1
(45) Date of Patent: Jun. 2, 2026

(54) STEERING SYSTEM AND METHOD CONTROLLING STEERING FOR A MARINE VESSEL

(71) Applicant: Brunswick Corporation, Mettawa, IL (US)

(72) Inventors: Matthew W. Snyder, Fond du Lac, WI (US); Aaron J. Ward, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 64 days.

(21) Appl. No.: 18/936,467

(22) Filed: Nov. 4, 2024

(51) Int. Cl.
*B63H 25/04* (2006.01)
*B63B 79/10* (2020.01)
*B63H 25/02* (2006.01)

(52) U.S. Cl.
CPC ..... *B63H 25/04* (2013.01); *B63B 79/10* (2020.01); *B63H 2025/022* (2013.01)

(58) Field of Classification Search
CPC .... B63H 25/04; B63H 2025/022; B63B 79/10
See application file for complete search history.

(56) References Cited

U.S. PATENT DOCUMENTS

| | | | |
|---|---|---|---|
| 4,893,800 | A | 1/1990 | Tabata |
| 6,273,771 | B1 | 8/2001 | Buckley et al. |
| 6,322,404 | B1 | 11/2001 | Magee et al. |
| 6,942,530 | B1 | 9/2005 | Hall et al. |
| 7,104,857 | B1 | 9/2006 | Swan et al. |
| 7,267,068 | B2 | 9/2007 | Bradley et al. |
| 7,398,742 | B1 | 7/2008 | Gonring |
| 7,727,036 | B1 | 6/2010 | Poorman et al. |
| 7,941,253 | B1 | 5/2011 | Brant |
| 8,113,892 | B1 | 2/2012 | Gable et al. |
| 8,265,830 | B2 | 9/2012 | Mizutani |
| 9,359,057 | B1 | 6/2016 | Andrasko et al. |
| 9,809,292 | B1 | 11/2017 | Gonring |
| 9,908,606 | B1 | 3/2018 | Andrasko et al. |
| 10,196,122 | B1 | 2/2019 | Andrasko et al. |
| 10,543,895 | B1 * | 1/2020 | McGinley ..... B63H 20/12 |
| 2012/0045951 | A1 | 2/2012 | Washino et al. |

OTHER PUBLICATIONS

Lord TFDR Steering Units for Steer-by-Wire Systems, Lord AskUsHow™, KP PB8130 (Rev.0 4/14), Lord Corporation, 8 pages.

* cited by examiner

*Primary Examiner* — Michael V Kerrigan
(74) *Attorney, Agent, or Firm* — Andrus Intellectual Property Law, LLP

(57) ABSTRACT

A system for controlling steering on a marine vessel includes a steering wheel movable within a fixed rotation range between a first fixed end stop and a second fixed end stop, a steering actuator configured to rotate the steerable component about the steering axis between a first steering limit and a second steering limit, and a controller configured to detect that the steering wheel position is in a first end region adjacent to the first fixed end stop or a second end region adjacent to the second fixed end stop while the steerable component is not at one of the steering limits. The steering actuator is controlled to rotate the steerable component at a fixed rotation rate while the steering wheel position is in the first end region or the second end region so as to move the steerable component toward alignment with the steering wheel position.

20 Claims, 6 Drawing Sheets

STEERING SYSTEM AND METHOD CONTROLLING STEERING FOR A MARINE VESSEL

FIELD

The present disclosure relates to systems and methods for controlling steering alignment of a marine vessel. More specifically, the present disclosure relates to steering control methods that adjust alignment between a steering wheel and a steerable component, such as marine drive.

BACKGROUND

The following U.S. Patents and Applications provide background information and are incorporated herein by reference in entirety.

U.S. Pat. No. 9,809,292 discloses a method for controlling steering alignment in a marine vessel includes detecting a rotational position of a steering device and detecting a rotational addition of a steerable component, wherein the steerable component is couplable to a marine vessel and steerable to a plurality of positions so as to vary the direction of movement of the marine vessel. The rotational position of the steering device and the rotational position of the steerable component are then compared. The operation between the steering device and the steerable component is then automatically adjusted while the steering device is moved by a user until alignment between the steering device and the steerable component is reached.

U.S. Pat. No. 10,196,122 discloses a method of operating a steer-by-wire steering system on a marine vessel includes receiving an initial component position of a steerable component and receiving an initial wheel position of a manually rotatable steering wheel with respect to a zero position. An initial normalized steering value is then calculated based on the initial component position, and the initial normalized steering value is correlated to the initial wheel position. The correlation between a subsequently received wheel position and a subsequently calculated normalized steering value is then adjusted by a recovery gain until the steering wheel reaches an aligned position with the steerable component.

SUMMARY

This summary is provided to introduce a selection of concepts that are further described below in the Detailed Description. This summary is not intended to identify key or essential features of the claimed subject matter, nor is it intended to be used to aid in limiting the scope of the claimed subject matter. In one aspect of the present disclosure, a system for controlling steering on a marine vessel includes a steering wheel movable within a fixed rotation range between a first fixed end stop and a second fixed end stop, a steering actuator configured to rotate the steerable component about the steering axis between a first steering limit and a second steering limit, and a controller configured to detect that the steering wheel position is in a first end region adjacent to the first fixed end stop or a second end region adjacent to the second fixed end stop while the steerable component is not at one of the steering limits. The steering actuator is controlled to rotate the steerable component at a fixed rotation rate while the steering wheel position is in the first end region or the second end region so as to move the steerable component toward alignment with the steering wheel position.

In one embodiment, the system further includes a first spring configured to compress against the first end stop when the steering wheel position is in the first end region, and a second spring configured to compress against the second end stop when the steering wheel position is in the second end region.

In another embodiment, the controller is further configured such that, when the steering wheel position is in the first end region, the steerable component is not rotated if it is at the first steering limit, and when the steering wheel position is in the second end region, the steerable component is not rotated if it is at the second steering limit.

In another embodiment, the system further includes a wheel position sensor configured to sense a position of a steering wheel within the fixed rotation range, and wherein the controller is configured to detect that the steering wheel position is in the first end region or the second end region based on an output of the wheel position sensor.

In another embodiment, the system further includes a first end sensor configured to sense that the steering wheel position is in the first end region and a second end sensor configured to sense that the steering wheel position is in the second end region and wherein the controller is configured to detect that the steering wheel position is in the first end region based on the output of the first end sensor and detect that the steering wheel position is in the second end region based on the output of the second end sensor.

In another embodiment, the controller is further configured to determine the fixed rotation rate based on a speed parameter of the marine vessel.

In another embodiment, the speed parameter is vessel speed.

In another embodiment, the speed parameter includes at least one of an RPM of a marine drive on the marine vessel, a propulsion demand, a throttle position of the marine drive, a torque output of the marine drive, or a current of the marine drive.

In another embodiment, the steerable component is a marine drive, and wherein the controller is configured to determine the fixed rotation rate based on a gear position of the marine drive.

In another embodiment, the system further includes a wheel position sensor configured to sense the position of a steering wheel within the fixed rotation range and wherein the controller is configured to, prior to controlling the steering actuator to rotate the steerable component at a fixed rotation rate while the steering wheel position is in the first end region or the second end region, identify a misalignment between the steering wheel and the steerable component based on a comparison of the sensed steering wheel position and the sensed rotational position of the steerable component.

In another aspect of the present disclosure, a method of controlling steering for a marine vessel includes detecting that a steering wheel position is in a first end region adjacent to the first fixed end stop or a second end region adjacent to the second end stop, while the steering wheel position is in the first end region or the second end region, detecting that the steerable component is not at the first steering limit or the second steering limit and thus is misaligned with the steering wheel position, and controlling a steering actuator to rotate the steerable component at a fixed rotation rate while the steering wheel position is in the first end region or the second end region and the steerable component is not at the first steering limit or the second steering limit so as to move the steerable component toward alignment with the steering wheel position.

In one embodiment, the steering wheel includes a first spring configured to compress against the first end stop when the steering wheel position is in the first end region, and a second spring configured to compress against the second end stop when the steering wheel position is in the second end region.

In another embodiment, detecting that the steering wheel position is in the first end region or the second end region includes detecting that the first spring is compressed or the second spring is compressed.

In another embodiment, the method further includes not rotating the steerable component when the steering wheel position is in the first end region if the steerable component is at the first steering limit and not rotating the steerable component when the steering wheel position is in the second end region if the steerable component at the second steering limit.

In another embodiment, the method further includes a wheel position sensor configured to sense a position of the steering wheel within the fixed rotation range and wherein the controller is configured to detect that the steering wheel position is in the first end region or the second end region based on an output of the wheel position sensor.

In another embodiment, the method further includes a first end sensor configured to sense that the steering wheel position is in the first end region and a second end sensor configured to sense that the steering wheel position is in the second end region, wherein the controller is configured to detect that the steering wheel position is in the first end region based on the output of the first end sensor and detect that the steering wheel position is in the second end region based on the output of the second end sensor.

In another embodiment, the controller is further configured to determine the fixed rotation rate based on a speed parameter of the marine vessel.

In another embodiment, the speed parameter includes at least one of an RPM of a marine drive on the marine vessel, a propulsion demand, a throttle position of the marine drive, a torque output of the marine drive, or a current of the marine drive.

In another embodiment, the steerable component is a marine drive, and wherein the controller is configured to determine the fixed rotation rate based on a gear position of the marine drive.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
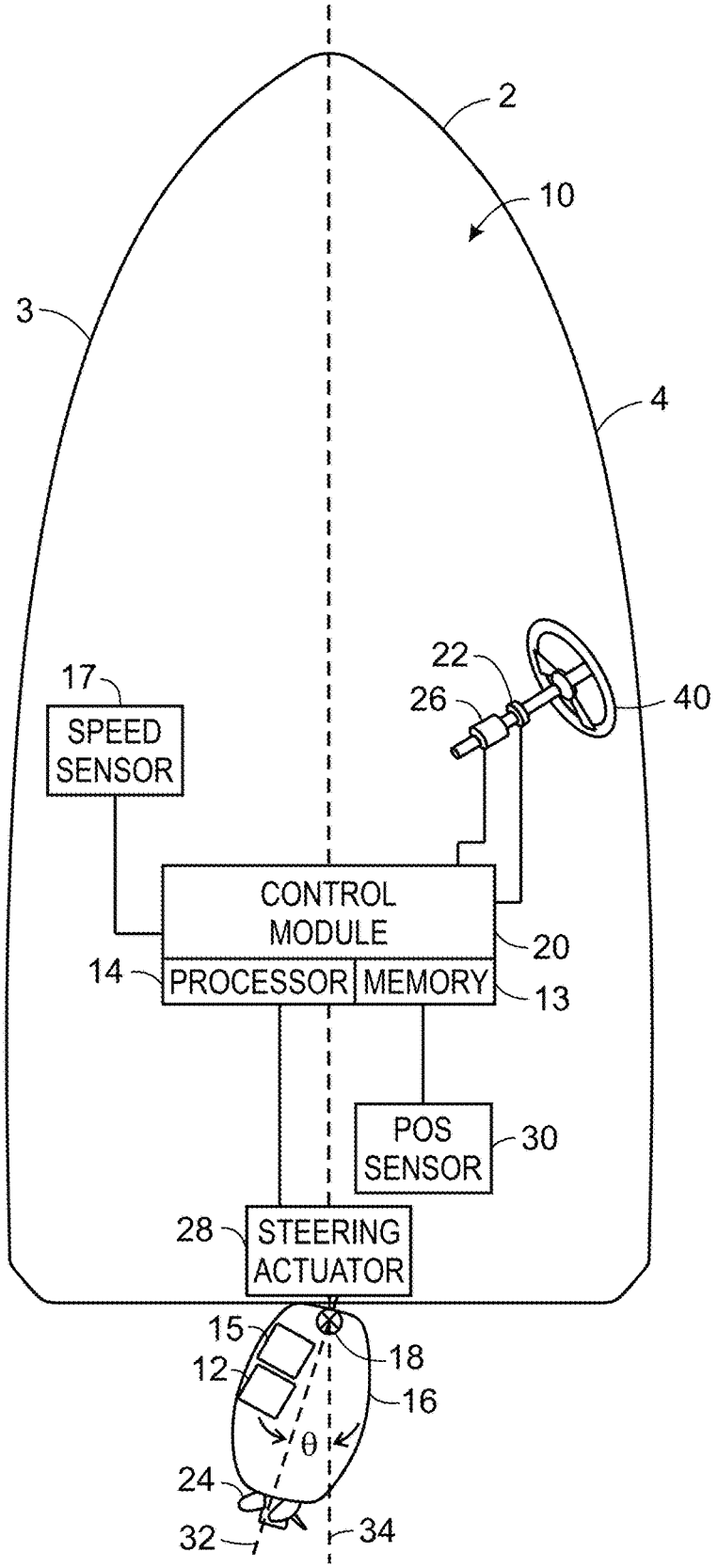
FIG. 1 is a schematic view of one embodiment of a steering system on a marine vessel.

Circumstances arise where a steering device, such as a steering wheel, becomes misaligned from the steerable component of a marine vessel, such as a marine drive or a rudder, such that a rotational position of a steering wheel does not align with a rotational position of the steerable component. The steerable component may be any type of steerable marine drive, such as an outboard, stern drive, or pod drive, or may be a steerable rudder. Misalignment may occur, for example, when switching from a steering mode that does not involve the steering wheel to steering wheel control. The steerable component(s) may be steered while the steering wheel does not move, such as by a user via the joystick in a joystick control mode or by the control system in an autonomous steering control mode, such as waypoint, station keeping, or a full autonomous navigation mode. When steering control is switched back to the steering wheel, the current position of the steerable component(s) and the position of the steering wheel may not be in alignment—i.e., the centered steering position of the steerable component does not align with the centered position of the wheel. In some digital steering control systems (often referred to as "steer-by-wire" systems), the current wheel position and the current component position(s) are correlated to one another at the time of transferring to steering wheel control and the steering wheel positions are mapped to component accordingly. Many steer-by-wire systems have adjustable end stops, and thus the end stop locations are digitally controlled and positioned based on the steering map such that the end stops of the steering wheel align with the steering limits of the steerable component. This allows any wheel position to be mapped to any drive position, and for steering control to proceed as normal.

However, the inventors have endeavored to develop a steer-by-wire system with fixed end stops, where the end stops are mechanically fixed and thus the wheel has a fixed rotation range between the two fixed mechanical end stops. Mechanical steering wheels with fixed end stops have cost and reliability advantages; however, they do not provide the ability to adjust the end stop locations. Thus, when the steering wheel position does not align with the drive position, the fixed end stops are asymmetrical with respect to the steering wheel position that is correlated to the centered component position. Likewise, the end stop positions no longer align with the steering limits of the steerable component(s). This means that one steering direction of the steering wheel will not be able to achieve the full steering range of the steerable component before hitting the end stop (i.e., will not steer the steerable component to its maximum steering position), and the other steering direction will achieve the maximum steering position of the steerable component well before reaching the end stop.

Some prior art steering alignment recovery methods implement automatic steering control of the steerable component or the wheel to automatically bring the two into an aligned position prior to initiating steering control with the steering wheel. The inventors recognized that such systems do not provide ability to switch to steering wheel control while the vessel is underway, including during operation at planing speeds. Other prior art steering alignment recovery methods implement gradual steering alignment recovery, such as applying adjustable steering gains where different wheel-to-component ratios in the two rotational directions to slowly move the centered wheel position toward the centered drive position. Examples of such solutions are shown and described at U.S. Pat. No. 10,196,122, which is incorporated herein by reference. However, the inventors have recognized that such systems may be insufficient to correct significant misalignments before the wheel reaches the end stop position, and thus may fail to provide full steering capabilities. Moreover, the inventors have recognized that it may be undesirable to provide drastically different steering responses in opposite steering directions, for example to avoid the user noticing an asymmetric steering response. Accordingly, the inventors recognized the need to create a different way of realigning the steering positions of both the marine drive and the steering wheel.

The disclosed methods and systems for controlling steering on a marine vessel include a steering wheel movable within a fixed rotation range between a first fixed end stop and a second fixed end stop and means for recovering alignment when the steering wheel is in the end stop regions at or near its end stops. The controller is configured to detect that the steering wheel position is in a first end region adjacent to the first fixed end stop or a second end region adjacent to the second end stop. When a steering wheel is positioned in one of the end stop regions while the steerable component is not at the respective steering limit, and thus a misalignment has resulted in the steerable component not being steered to its maximum steering limit by the time the steering wheel reaches its end stop, a corrective action is enabled that permits the drive to be steered toward the respective steering limit while the steering wheel remains in the end stop region. The controller controls the steering actuator to rotate the steerable component at a fixed rotation rate while the steering wheel position is in the first end region or the second end region and the steerable component is not at the first steering limit or the second steering limit. Thereby, the user is able to command the rest of the steering range of the steerable component in that direction while progression toward alignment between the steerable component and the steering wheel is also achieved.

When the steering wheel is turned the other direction, the steerable component will reach its steering limit (i.e., the maximum angle about its steering axis that it is permitted to be steered to) prior to the steering wheel reaching the other end stop. There, once the steerable component is steered to its steering limit, any further rotation of the wheel will not result in a change in position of the steerable component. However, rotation of the steering wheel back toward the centered position will result in turning the steerable component back toward its centered position. Thereby, the user is able to command the full steering range of the steerable component(s) in both directions, and the system moves the steerable component toward alignment with the steering wheel position when the steering wheel is at each end stop region.

In one embodiment, the system includes a mechanical device placed in the rotation range of the steering wheel and near each end stop, wherein the mechanical device is configured to provide mechanical feedback to the user that they have moved the steering wheel into the end region. For example, the mechanical device may be a spring configured to compress against the end stop as the wheel reaches the end stop, where the end stop region is the compression region of the spring—i.e., the region of the steering wheel turn where the spring is compressed between an internal mechanism of the wheel and the end stop. Thereby, mechanical feedback is provided to the user by the spring-loaded deadband at the end stops. Namely, the user can tell that the steering wheel is in the end stop region by the compression force provided by the spring and can push against that force to command continued rotation of the steerable component. In other embodiments, a different mechanical feedback arrangement may be provided to indicate to the user that the steering wheel is in the end stop region, such as a detent arrangement.

In some embodiments, the system may include a switch or other sensing device configured to sense when the steering wheel has reached the end stop region. In one embodiment, when the user turns the wheel into this deadband, a switch is depressed and indicates to the steering control system that the steering wheel position has entered an end region, e.g., where the spring is in contact with the end stop and the internal rotating component of the steering wheel, wherein the controller commands continued rotation of the steerable component at a fixed rate while the steering wheel is within the end region. Similarly, other sensor arrangements may be provided to detect when the steering wheel is in the end region.

In some embodiments, the fixed rotation rate may be the same rotation rate in all conditions. In other embodiments, the control system is configured to determine the fixed rotation rate of the steerable component when the steering wheel reaches the end stop region, and that determined fixed rotation rate is implemented while the steering wheel remains in the end stop region regardless of how hard the user turns the wheel against the end stop or progresses the wheel position into the end stop region. For example, the fixed rotation rate may be determined based on a speed parameter of the vessel, such as vessel speed (e.g., speed over ground or speed over water), RPM of the marine drive (e.g., powerhead RPM or propeller RPM), propulsion demand (e.g., lever position of a throttle lever), throttle position (e.g., position of a throttle valve), torque output of the drive, power consumption or current (e.g., of an electric motor powerhead in the case of an electric marine drive), or the like.

FIG. 1 illustrates a marine vessel 2 having a port side 3 and a starboard side 4. A steerable component 16 is located on the marine vessel 2 and positioned to effectuate a force thereon to control the direction of motion of the vessel, such as a propeller imparting a thrust near a stern of the marine vessel 2. In the example shown, the steerable component 16 is couplable to, or able to be coupled into, the steering system 10 of the marine vessel 2. The steerable component 16 may comprise any of a pod drive, an outboard motor, a stern drive, or a jet drive, or any other type of steerable marine drive. Alternatively, the steerable component may be a steerable rudder. The steerable component and the disclosed methods of controlling steering alignment are applicable to propulsion systems comprising internal combustion engines (ICE) and/or electric marine drives. When the propulsion system comprises an ICE marine drive, the controller may receive output from the transmission 15 and/or the powerhead 12 to determine adjustments to the steering position of the marine drive(s). As disclosed below, the gear position of transmission 15 and/or the output from the powerhead 12 or other portion of the marine drive may be used to determine the fixed rotation rate of the marine drive as the controller adjusts the rotational position of the marine drive to realign with the steering position of the steerable component (e.g., a steerable drive or a rudder) with position of the steering wheel.

Thus, the steerable component 16 may be coupled in torque transmitting relationship with a powerhead via an output shaft. In a stern drive embodiment, for example, the steerable component 16 may include a propeller shaft that connects to a propeller 24. Alternatively, in an outboard embodiment, the steerable component may include the entire outboard, which is rotated about vertical steering axis 18. When torque is transmitted from the powerhead 12 to the propeller shaft and the propeller 24, a thrust is produced to propel the marine vessel 2 in a direction that corresponds to a steering position of the steerable component 16. Alternatively, if the marine vessel may be provided with an inboard drive, the steerable component 16 may be a rudder.

Figure 2:
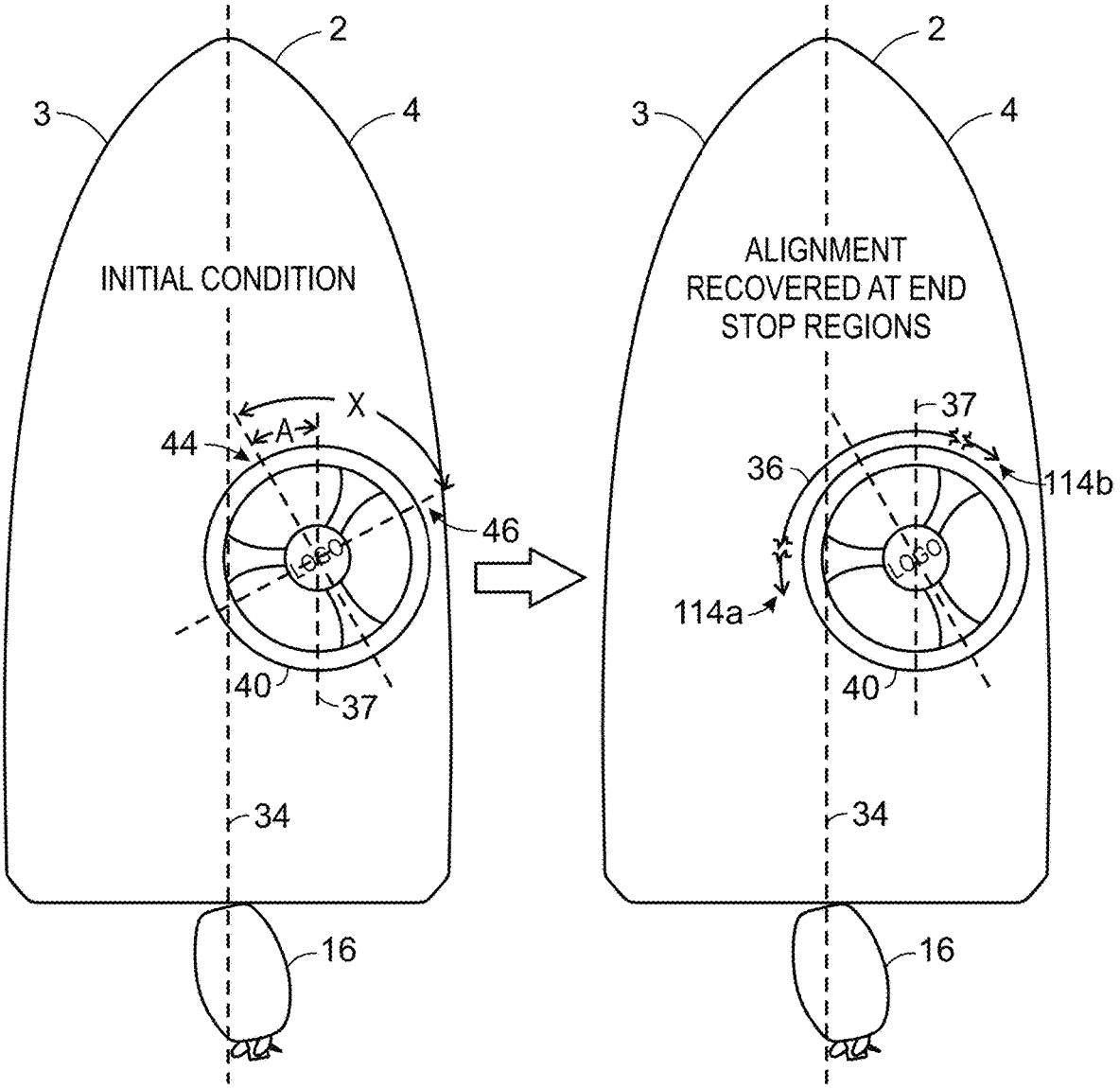
FIG. 2 illustrates one embodiment of a system and method of operating a steer-by-wire steering system to achieve alignment between a steerable component and the steering wheel.

In the example of FIGS. 1 and 2, the steerable component 16 is an outboard marine drive steerable around a vertical steering axis 18, it being understood that different types of marine vessels and steerable components may have steering axes that are not vertically aligned. The rotation about steering axis 18 is actuated by a steering actuator 28, which actuates the steerable component 16 to one of a plurality of positions so as to control direction of movement of the marine vessel 2. The steering actuator 28 may be, for example, any hydraulic, electric, or electric over hydraulic steering actuator. For example, the steering actuator 28 may be a hydraulic pump that pumps pressurized hydraulic fluid through a control valve to either side of a piston cylinder, as is common and known in the relevant art, to control movement of the steerable components 16. A position sensor 30 is located on or associated with the steering actuator 28 or the steerable component 16 to sense a steering position or steering angle of the steerable component 16, referred to herein as the component position. The component position may be, for example, a distance or an angle between a center axis 32 of the steerable component 16 from the center line 34 of the marine vessel 2 (or a line parallel thereto, if the steering system 10 includes multiple marine drives), which is depicted as angle θ in FIG. 1.

This type of digitally-controlled steering arrangement is commonly referred to in the art as a "steer-by-wire" system, wherein there is no direct mechanical connection between the steering wheel 40 and the steering actuator 28 or the steerable component 16, but such control is provided by one or more controllers 20 receiving inputs from the various components in the steering system 10 and controlling the steering actuator 28 accordingly. For example, such communication between the various components within the system 10 may be provided on a communication bus, such as on a controller area network (CAN) bus. In other embodiments, however, any type of wired or wireless communication may be provided between the various devices. In the embodiment depicted in FIG. 1, the communication link lines are meant only to demonstrate that the various elements are capable of communicating to or between one another and do not represent actual wiring connections between the various elements, nor do they represent the only paths of communication between the elements.

In one embodiment, a certain rotation of the steering wheel 40 gets related to an amount of rotation of the steerable component 16, and such relation is generally provided by one or more drive angle maps stored in memory of one or more controllers within the steering system 10. In certain embodiments, the relation between the angle of the steering wheel 40 and the angle of the steerable component 16 may vary for a particular marine vessel depending on vessel conditions, such as vessel speed, engine speed, engine load, or the like. Each of the one or more drive angle maps may associate a sensed position of the steering wheel 40 with a particular position of the steerable component 16, which may also be a particular position of the steering actuator 28. For example, the position of the steering wheel 40 may be sensed by a wheel position sensor 22 associated with the steering wheel, which may be, for example, an encoder or transducer or other type of position sensor, many of which are conventional for such applications. In other embodiments, the position of the steerable component may be correlated with a normalized steering value. In certain embodiments, the steering wheel position is normalized, such as to a scale between −100% and 100%, and the movement of the steerable component 16 is correlated to that normalized steering value regardless of whether the two are aligned. The steering ratio between the steering wheel and steerable component may be the same under all conditions, where alignment recovery is then executed when the wheel is in the end stop regions. Alternatively, the steering ratio between the steering wheel and the steerable component may be selected based on vessel conditions, such as based on a speed parameter. This allows for flexible steering implementation, where the range of possible component position angles can be adjusted independently of the correlation with sensed positions of the steering wheel 40. For example, the steering system 10 may be configured to provide a wider range of component positions (e.g., drive angles of an outboard motor) and a corresponding steering ratio at lower vessel speeds, and then restrict the possible range of component positions as the vessel speed increases.

The steering wheel includes a mechanical rotation control system 26 that includes fixed end stops, such as fixed posts or other structural elements that an internal rotating mechanism of the steering wheel contacts to stop rotation of the wheel in that direction. An exemplary embodiment of the mechanical rotation control system 26 with fixed end stops is shown and described with respect to FIG. 4.

Adjustment of the steerable component steering position may be based on other inputs from elements within the system 10. For example, as explained in greater detail below, the controller may receive a vessel speed from a speed sensor 17 that measures speed of travel of the marine vessel 2. The speed sensor 17 may be any device capable of measuring or determining the speed of the marine vessel 2, and in exemplary embodiments may include a pitot tube or a paddle wheel configured to sense the vessel's speed over water, or may include a global positioning system (GPS)-based speed determination system configured to sense the vessel's speed over ground. Alternatively or additionally, the relation between the steering input provided at the steering wheel 40 and the steering position of the steerable component 16 may further be based on powerhead speed or powerhead load or torque within one or more marine drive(s) of the marine vessel 2.

The steering system 10 includes one or more controllers that, under the direction of the central controller, provide the control function and methods described herein for controlling position of the steerable component 16 based on inputs provided at the steering wheel 40. In the depicted embodiment, a controller 20 receives inputs regarding the wheel position of the steering wheel 40 from the position sensor 22 and receives inputs regarding the steering position of the steerable component 16 from position sensor 30. In the depicted embodiment, the controller 20 also receives input from speed sensor 17.

The controller 20 then controls steering of the steerable component 16 by sending control signals to the steering actuator 28 causing it to move the steerable component 16 to the aligned steering position at a fixed rotation rate. In various embodiments, the steering system 10 may include one or more controllers that perform various aspects of the disclosed method. For example, the steering control logic may be split between a helm controller providing central control of various aspects of the marine vessel, and other controllers, such as a CAN-based control module associated with the steering wheel. Thus, although the controller 20 is represented in the depicted embodiment as a single controller including memory 13 and a programmable processor 14, the controller 20 may actually be embodied as multiple different control modules. For instance, the steering system 10 may incorporate a central controller, such as a helm control module, and a CAN-based steering wheel control module communicatively connected to the controller, wherein both modules cooperate to provide the control functions described herein. In other embodiments, some or all of the control functions described herein may be performed by one or more CAN-based or other control modules associated with the steering wheel 40 and/or the steering actuator 28, with no input from a central controller.

The systems and methods described herein may be implemented with one or more computer programs executed by one or more processors, which may all operate as part of a single control module 20 or as separate control modules as described above. The computer programs include processor-executable instructions stored on a non-transitory tangible computer readable medium. The computer programs may also include stored data. Non-limiting examples of the non-transitory tangible computer readable medium are non-volatile memory, magnetic storage, and optical storage.

As used herein, the term controller may refer to, be part of, or include an application-specific integrated circuit (ASIC), an electronic circuit, a combinational logic circuit, a field programmable gate array (FPGA), a processor (shared, dedicated, or group) that executes code, or other suitable components that provide the described functionality, or a combination of some or all of the above, such as in a system-on-chip. The term controller may also refer to multiple control modules that are communicatively connected and configured to carry out the functions described herein. The controller may include memory (shared, dedicated, or group) that stores code executed by the processor. The term code, as used herein, may include software, firmware, and/or microcode, and may refer to programs, routines, functions, classes, and/or objects. The term shared, as used above, means that some or all code from multiple control modules may be executed using a single (shared) processor. In addition, some or all code to be executed by multiple different processors may be stored by a single (shared) memory. The term group, as used above, means that some or all code comprising part of a single controller may be executed using a group of processors. Likewise, some or all code comprising a single controller may be stored using a group of memories.

It will be understood by a person having ordinary skill in the art in view of this disclosure that the principles discussed herein with reference to a single steerable component 16 are equally applicable to two or more steerable components 16 on a marine vessel, such as two or more marine drives or two or more rudders, and the number of steerable components 16 is not limiting on the scope of the present disclosure.

As described above, a situation may occur where the position of the steering wheel 40 is not in alignment with the position of the steerable component 16. For example, such misalignment may occur where a control element other than the steering wheel 40 was controlling position of the steerable component 16. In various embodiments, other steering control elements may include a joystick, an automatic heading or position control system, or the steering wheel of another helm (i.e. in a marine vessel having two helms).

Figure 3:
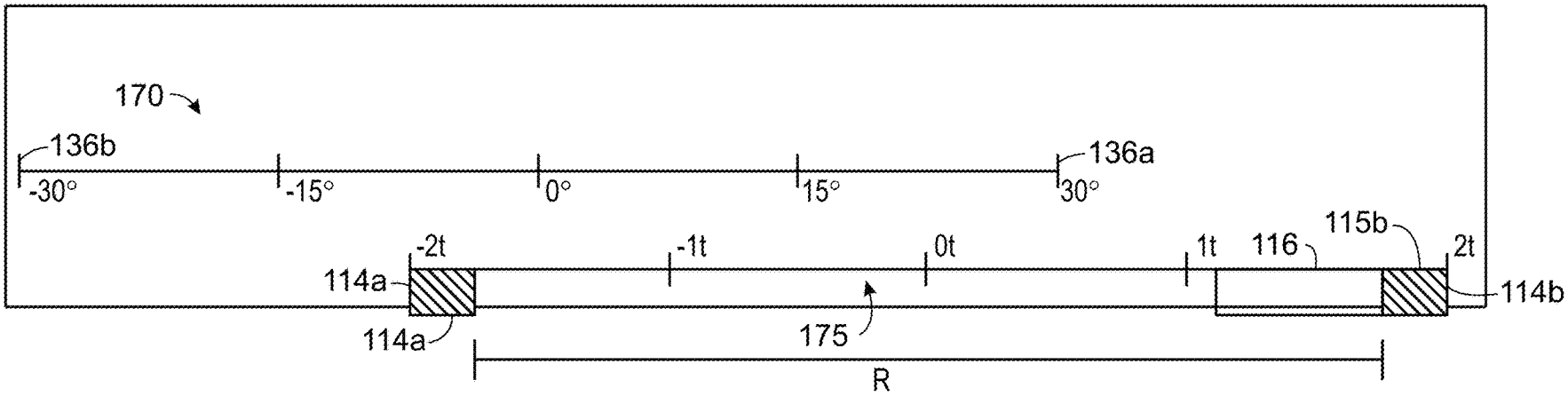
FIG. 3 depicts a misalignment of a fixed rotation range of the steering wheel and the marine drive, according to some embodiments of the present disclosure.

As described above, in view of their recognition of the forgoing problems and challenges with the prior art, the present disclosure provides a system and method whereby alignment can be corrected during the course of steering operation by a user. Correction is provided during the steering process as the steering position enters an end region, wherein the steering wheel 40 can be brought into centered alignment with the steerable component 16 without any abrupt changes to the steering system and in a way that is minimally disruptive to the user. Thus, the system 10 adjusts the operation between the steering wheel 40 and the steerable component 16 while the steering wheel position remains within either one of the end regions until such time as alignment is reached. For example, the steerable component 16 is rotated at a fixed rotation rate in the direction of the respective steering limit while the steering wheel position is within the end region. FIGS. 2 and 3 provide an illustrative examples of the steering adjustment strategy. In an initial condition, the wheel position of the steering wheel 40 is at a turned position 44, at angle A with respect to the centered wheel position (which is the positioned centered evenly between the two fixed end stops). The steerable component 16 (here, an outboard motor) is steered to an angle with respect to the center line 34 of the marine vessel 2 such that it would effectuate a starboard turn of the vessel 2. Thus, misalignment has occurred between the steering wheel 40 and the steerable component 16. For example, this may represent the position of the steerable component(s) 16 (here an outboard drive) and the steering wheel 40 when the user first switches to a control mode wherein steering is controlled with the steering wheel 40.

As depicted in the example of FIG. 2, the steering wheel 40 is misaligned from the steerable component 16, where the steering wheel 40 is rotated toward the port side 3 compared to its centered wheel position 37 and the steerable component 16 is rotated to a position that would effectuate a starboard turn of the vessel. Thus, the steering wheel 40 and the steerable component 16 are significantly misaligned. Dashed line 46 represents the aligned position of the steering wheel that would be aligned with the component position, if the wheel and the component were in proper alignment. The misalignment is represented by angle X.

An alignment adjustment needs to be made to move the steerable component 16 relative to the position of the steering wheel 40 and into alignment therewith. As illustrated on the right side of FIG. 2, steering alignment is achieved at the end stops 114*a*, 114*b* of the fixed rotation range represented by arrow 36. The fixed rotation range is the rotational distance between the end stops 114*a* and 114*b*. To provide just one example, the fixed rotation range may be 4 full turns of the steering wheel between the end stops 114*a* and 114*b*. In the depicted misalignment scenario, the steering wheel will reach the at end stop 114*a* before the drive reaches the corresponding steering limit. The system is configured such that the steering wheel position can be maintained within the end region adjacent to end stop 114*a* while the position of the steerable component is adjusted at a fixed rate until it reaches the steering limit. At the other end stop 114*b*, the drive will reach its steering limit well before the steering wheel reaches the end stop 114*b*. At that point, the steering wheel 40 is moved toward alignment with the drive by not changing the component position of the drive beyond the steering limit while the steering wheel is moved toward that end stop 114*b*.

Before reaching the end stop region and before the steerable component reaches the steering limit, the steerable component 16 is steered by the steering actuator based on the position of the steering wheel 40. The steering ratio between the steering wheel turn and the ratio of the steerable component may be the same in both directions, and may be a static value or may be based on a speed parameter or other operation value. In other embodiments, the disclosed end stop alignment method may be used in conjunction with a gain schedule, such as one of the gain strategies shown and described at U.S. Pat. No. 10,196,122, to move the steering wheel and steerable component toward alignment while steering is underway. For example, the system may be configured to implement a moderate gain schedule that would not be noticeable to or otherwise disrupt the operator to slowly compensate for some of the misalignment, and the remainder of the misalignment can be removed at the end stop regions to expedite the realignment process.

FIG. 3 depicts a similar misalignment as FIG. 2 between the fixed rotation range 175 of the steering wheel and the steering range 170 of the marine drive (or other steerable component), which is also fixed. The steering wheel is movable within the fixed rotation range 175 between a first fixed end stop 114*a* and a second fixed end stop 114*b*. Each end region 115*a*, 115*b* is a small portion of the fixed rotational range adjacent to an end stop 114*a*, 114*b*, such as a rotational distance between two and ten degrees from the end stop 114*a*, 114*b*, such as five degrees from the end stop 114*a*, 114*b*. Under normal operating conditions when the steering wheel and the steerable component are aligned, the steerable component reaches the steering limit 136*a*, 136*b* right before the steering wheel reaches the end region 115*a*, 115*b* or right at the point where the steering wheel reaches the end region 115*a*, 115*b*. Thus, during aligned conditions, the component is fully steered between steering limits 136*a* and 136*b* when the steering wheel is turned the entire range R between (but not including) the end regions 115*a*, 115*b*. The range R is the fixed rotation range 175 minus the end regions 115*a*, 115*b*. In the depicted example, the range R of the steering wheel is 4 turns minus the two 5 degree end regions 115*a* and 155*b*.

The end region 115*a* is the end region of the steering wheel fixed rotation range 175. Here, due to the misalignment, when the steering wheel position reaches the first end region 115*a*, there remains a rotation range for the drive (i.e., the drive is not turned to its respective steering limit 136*a*). While the steering wheel is held in a position within the end region 115*a*, the steerable device is steered at a fixed rate until it reaches the respective steering limit 136*a* or until the user moves the steering wheel back out of the end region 115*a*. Once the steerable device reaches the respective steering limit while the steering wheel position remains in the end region 115*a*, alignment is achieved.

At the other end of the fixed rotation range 175, the steerable device will reach the steering limit 136*b* prior to the steering wheel reaching the end region 115*b*. Thus, a portion of the fixed rotation range operates as a lost range 116, wherein the steerable device is at the steering limit 136*b* and thus cannot be turned any further in that direction. While the steering position is within the lost range 116, the drive will not be turned further toward the steering limit 136*b* and thus no vessel steering response will be effectuated when the steering wheel is turned further toward the end stop 114*a*. However, to the extent that the steering wheel is rotated in the opposite direction back toward the centered position, a steering response will be effectuated to move the drive in the corresponding steering direction (here, away from the steering limit 136*b*). That resets the steering alignment and the lost range 116 accordingly.

In one embodiment, the fixed rotation rate may be a static and preset value that is always utilized for effectuating steering alignment. Alternatively, the fixed rotation rate may be determined at the time of the wheel entering the end region 115*a*, 115*b*. The controller may be configured to determine the fixed rotation rate based on the conditions of the marine vessel as the steering wheel position enters the end region 115*a*, 115*b*, such as a speed parameter of the marine vessel. For example, the fixed rotation rate may be based on how fast the marine vessel is traveling when the steering wheel position enters the end region 115*a*, 115*b*. The fixed rotation rate may be speed-adjusted to ensure that adjustments to the rotational position of the steerable component is appropriate for the vessel speed. The steerable component may rotate more quickly when moving at a slower vessel speed and rotate more slowly when moving at a faster vessel speed. Additionally or alternatively, other vessel speed parameters may be used by the controller to determine the fixed rotation rate, such as an RPM of a marine drive, a propulsion demand, a throttle position of an ICE marine drive, a torque output of the marine drive, and/or a current or power consumption of the marine drive with an electric drive system. The RPM may be powerhead RPM, propeller RPM, or some rotational speed value measured at any point between the powerhead and the propeller. The propulsion demand may be a helm demand (e.g., lever position of a throttle lever) or a demand percent commanded to the marine drive(s).

Alternatively, the fixed rotation rate may be determined based on a gear position of a transmission of the one or more marine drives (or alternatively, in an electric drive implementation, could be based on the direction of rotation of the motor). For example, a first fixed rotation rate may be assigned if the gear position is a neutral position and a second fixed rotation rate may be assigned if the gear position is a forward position, where the first fixed rotation rate utilized in neutral is greater than the second fixed rotation rate utilized in forward. In one embodiment, a third rate may be assigned if the transmission in in reverse (or the rotation direction of the motor is backwards), such as a rate magnitude between the first rate and the second rate. In embodiments with more complex gear systems with multiple forward gears, for example, such as an ICE drive system with a transmission, the fixed rotation rate may be assigned for each of multiple different forward gear positions of the transmission. Thus, one of multiple different rotation rates is selected based on the gear position (or rotation direction of the motor) at the time the steering wheel enters the end region 115*a*, 115*b*.

Figure 4:
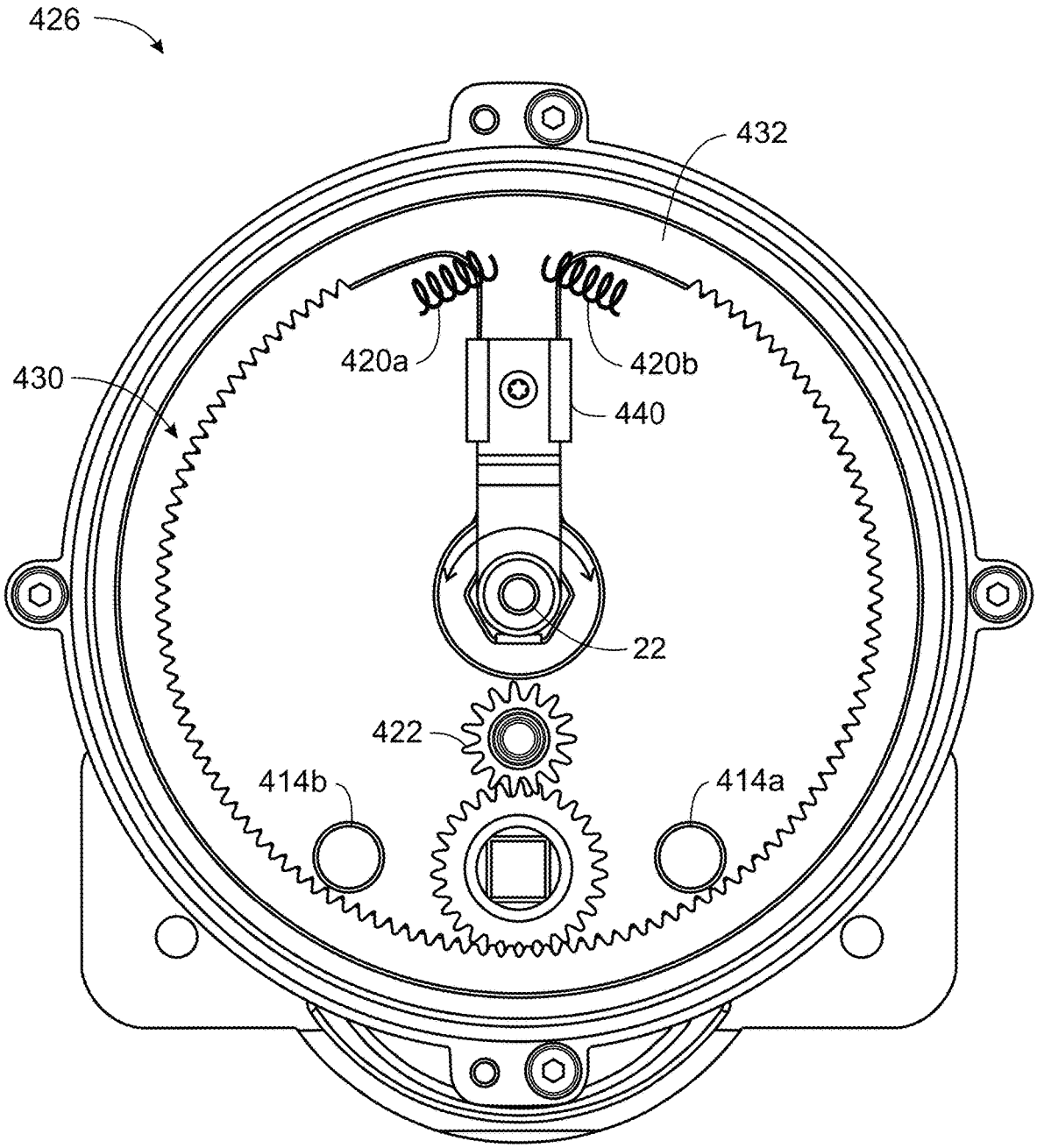
FIG. 4 depicts an exemplary fixed rotation range including a first fixed end stop and a second fixed end stop.

FIG. 4 depicts an exemplary mechanical rotation control system 426 of a steering wheel, including a first fixed end stop 414*a* and a second fixed end stop 414*b*. The wheel attached gear 422 translates the rotation of the steering wheel to rotation within the internal rotation mechanism 430. In this embodiment, rotation of the wheel attached gear 422 is translated to movement of an outer gear 432 attached to the strut 440. Thus, as the steering wheel turns, the strut 440 is rotated around within the fixed rotation range of the wheel between end stops 414*a* and 414*b*. In the depicted embodiment, the fixed rotation range is measured from the point where the strut 440 contacts end stop 414*a* (or maximally compresses the spring 420*a*) to the point where the strut 440 contacts end stop 414*b* (or maximally compresses the spring 420*b*), which for example may be approximately four turns.

The end regions are defined by the interaction of one or more components, such as a first fixed end stop 102*a*, a second fixed end stop 102*b*, a strut 104, mechanical devices such as the springs 420*a*, 420*b*, and/or a wheel position sensor 22. Here, the first end region is defined by the first spring 420*a* contacting and compressing against the first end stop 414*a*. The second end region is defined by the second spring 120*b* contacting and compressing against the second end stop 141*b*.

In the depicted embodiment, the start of each end region is the point at which one of the springs 420*a*, 420*b* makes contact with the respective end stop 414*a*, 414*b*, where the springs are attached to the strut 440 and thus move into contact with the fixed end stop 414*a*, 414*b*. In another embodiment, the springs may be attached to the fixed end stops 414*a*, 414*b*, where the first spring 420*a* is connected to the first fixed end stop 102*a* and the second spring 420*b* is second fixed end stop 102*b*. In such an embodiment, the start of each end region would be the point at which the strut 440 contacts the spring attached to the end stop 141*a*, 414*b*.

In still other embodiments, different mechanical device may provide mechanical, or tactile, feedback to the user that the steering wheel is in the end region. For example, a detect mechanism may be positioned adjacent to each end stop 414*a*, 414*b* and configured such that the outer gear 432 (for example) has a section of increased resistance upon entering the end region. In another embodiment, the steering wheel rotation arrangement may include a hydraulic damper (such as a dashpot) positioned to provide resistance when the steering wheel reaches the end region.

The controller may detect that the steering wheel position is in the first end region 115*a* or the second end region 115*b* in one or more ways. In one embodiment, an end sensor may be positioned and configured to sense when the strut 440 (or other internal rotating mechanism that travels along the fixed rotation range) impacts the end stop 414*a*, 414*b* (or the spring 420*a*, 420*b* is on contact with both the end stop 414*a*, 414*b* and the strut 440. For example, contact sensors (may be attached to each of the springs 420*a*, 420*b* and/or to the fixed end stops 414*a*, 414*b* to sense contact therewith. For example, the end sensor(s) may be switches configured to close upon contact between the strut 440, a spring 420*a*, 420*b*, and an end stop 414*a*, 414*b*. Detection by the controller that the steering wheel position is in an end region is then based on the output of the end sensor.

Alternatively or additionally, the controller may be configured to determine that the steering wheel position is in an end region based on the output of the wheel position sensor 22. For example, the controller may be configured to determine that the steering wheel is in an end region when the wheel position sensor 22 indicates that the rotation position is within a predetermined range of an end stop 414*a*, 414*b*, such as within five degrees of the end stop. Namely, when the steering wheel has rotated such that the steering position is within the last five degrees of the fixed rotation range in either rotation direction, the controller may identify the steering wheel position as being within the end region.

Figure 5:
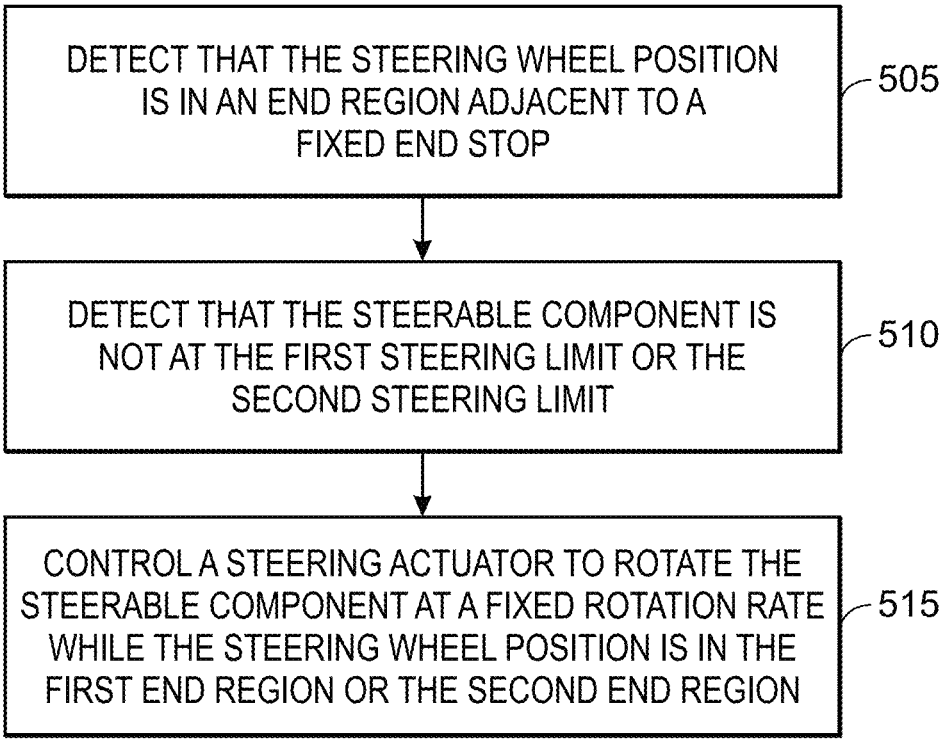
FIGS. 5 and 6 illustrated exemplary method steps for controlling steering alignment on a marine vessel.

FIG. 5 depicts exemplary method steps for controlling steering for a marine vessel. At step 505, the controller detects that the steering wheel position is in a first end region adjacent to the first fixed end stop or a second end region adjacent to the second end stop. In one embodiment, the first end region is defined by a first spring that is configured to compress against the first end stop when the steering wheel position is in the first end region, and the second end region is defined by a second spring configured to compress against the second end stop. At 510, the controller detects that the steerable component is not at the first steering limit or the second steering limit. For example, the component position is based on the output of a component position sensor configured to sense the rotational position of the component about its steering axis. A misalignment between the steering wheel and the steerable component is thus identified. At 515, the controller controls a steering actuator to rotate the steerable component at a fixed rotation rate while the steering wheel position is in the first end region or the second end region and in the direction corresponding with the respective end region.

Figure 6:
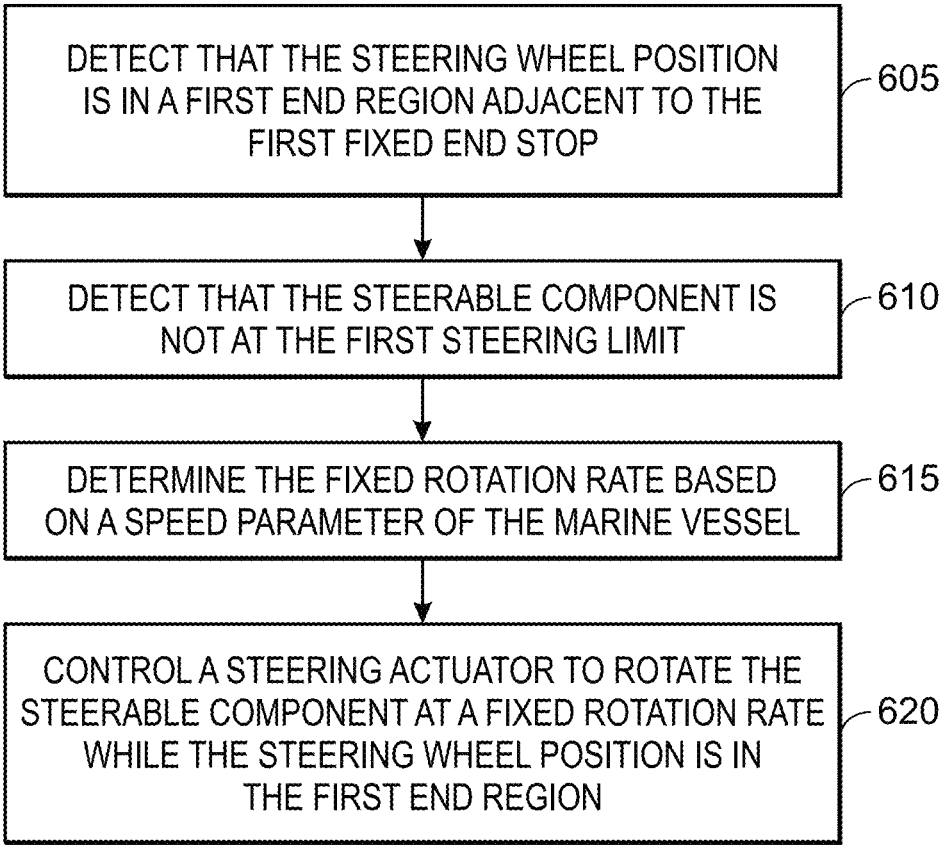

FIG. 6 depicts exemplary method steps for controlling steering for a marine vessel. At 605, the controller detects that the steering wheel position is in a first end region adjacent to the first fixed end stop. At 610, the controller detects that the steerable component is not at the first steering limit. At 615, the controller determines the fixed rotation rate based on a current speed parameter of the marine vessel. The speed parameter may include or be based on, for example, a vessel speed (e.g., vessel speed over ground or vessel speed over water), an RPM of a marine drive on the marine vessel, a propulsion demand, a throttle position of the marine drive, a torque output of the marine drive, or a current of the marine drive. At 620, the controller controls a steering actuator to rotate the steerable component at the fixed rotation rate toward the first steering limit while the steering wheel position is in the first end region.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A system for controlling steering on a marine vessel, the system comprising:

a steering wheel movable within a fixed rotation range between a first fixed end stop and a second fixed end stop;

a component position sensor configured to sense a rotational position of a steerable component coupled to the marine vessel and steerable to a plurality of positions so as to vary a direction of movement of the marine vessel;

a steering actuator configured to rotate the steerable component about a steering axis between a first steering limit and a second steering limit;

a controller configured to:

detect that a steering wheel position is in a first end region adjacent to the first fixed end stop or a second end region adjacent to the second fixed end stop while the steerable component is not at the first steering limit or the second steering limit and thus misaligned with the steering wheel position; and control the steering actuator to rotate the steerable component at a fixed rotation rate while the steering wheel position is in the first end region or the second end region and the steerable component is not at the first steering limit or the second steering limit so as to move the steerable component toward alignment with the steering wheel position.

2. The system of claim 1, further comprising a first spring configured to compress against the first fixed end stop when the steering wheel position is in the first end region, and a second spring configured to compress against the second fixed end stop when the steering wheel position is in the second end region.

3. The system of claim 1, wherein the controller is further configured such that, when the steering wheel position is in the first end region, the steerable component is not rotated if it is at the first steering limit, and when the steering wheel position is in the second end region, the steerable component is not rotated if it is at the second steering limit.

4. The system of claim 1, further comprising a wheel position sensor configured to sense a position of the steering wheel within the fixed rotation range; and wherein the controller is configured to detect that the steering wheel position is in the first end region or the second end region based on an output of the wheel position sensor.

5. The system of claim 1, further comprising a first end sensor configured to sense that the steering wheel position is in the first end region and a second end sensor configured to sense that the steering wheel position is in the second end region;

wherein the controller is configured to detect that the steering wheel position is in the first end region based on an output of the first end sensor and detect that the steering wheel position is in the second end region based on an output of the second end sensor.

6. The system of claim 1, wherein the controller is further configured to determine the fixed rotation rate based on a speed parameter of the marine vessel.

7. The system of claim 6, wherein the speed parameter is vessel speed.

8. The system of claim 6, wherein the speed parameter includes at least one of an RPM of a marine drive on the marine vessel, a propulsion demand, a throttle position of the marine drive, a torque output of the marine drive, or a current of the marine drive.

9. The system of claim 1, wherein the steerable component is a marine drive, and wherein the controller is configured to determine the fixed rotation rate based on a gear position of the marine drive.

10. The system of claim 1, further comprising a wheel position sensor configured to sense the steering wheel position within the fixed rotation range; and wherein the controller is configured to, prior to controlling the steering actuator to rotate the steerable component at a fixed rotation rate while the steering wheel position is in the first end region or the second end region, identify a misalignment between the steering wheel and the steerable component based on a comparison of the sensed steering wheel position and the sensed rotational position of the steerable component.

11. A method of controlling steering for a marine vessel, the method comprising:

detecting that a steering wheel position is in a first end region adjacent to a first fixed end stop or a second end region adjacent to a second fixed end stop;

while the steering wheel position is in the first end region or the second end region, detecting that a steerable component is not at a first steering limit or a second steering limit and thus is misaligned with the steering wheel position; and controlling a steering actuator to rotate the steerable component at a fixed rotation rate while the steering wheel position is in the first end region or the second end region and the steerable component is not at the first steering limit or the second steering limit so as to move the steerable component toward alignment with the steering wheel position.

12. The method of claim 11, wherein a first spring compresses against the first fixed end stop when the steering wheel position is in the first end region, and a second spring compresses against the second fixed end stop when the steering wheel position is in the second end region.

13. The method of claim 12, wherein detecting that the steering wheel position is in the first end region or the second end region includes detecting that the first spring is compressed or the second spring is compressed.

14. The method of claim 11, further comprising:

not rotating the steerable component when the steering wheel position is in the first end region if the steerable component is at the first steering limit; and not rotating the steerable component when the steering wheel position is in the second end region if the steerable component at the second steering limit.

15. The method of claim 11, further comprising a wheel position sensor configured to sense a position of a steering wheel within a fixed rotation range between the first fixed end stop and the second fixed end stop; and wherein the controller is configured to detect that the steering wheel position is in the first end region or the second end region based on an output of the wheel position sensor.

16. The method of claim 11, further comprising a first end sensor configured to sense that the steering wheel position is in the first end region and a second end sensor configured to sense that the steering wheel position is in the second end region;

wherein the controller is configured to detect that the steering wheel position is in the first end region based on an output of the first end sensor and detect that the steering wheel position is in the second end region based on an output of the second end sensor.

17. The method of claim 11, wherein the controller is further configured to determine the fixed rotation rate based on a speed parameter of the marine vessel.

18. The method of claim 17, wherein the speed parameter is vessel speed.

19. The method of claim 17, wherein the speed parameter includes at least one of an RPM of a marine drive on the marine vessel, a propulsion demand, a throttle position of the marine drive, a torque output of the marine drive, or a current of the marine drive.

20. The method of claim 11, wherein the steerable component is a marine drive, and wherein the controller is configured to determine the fixed rotation rate based on a gear position of the marine drive.

* * * * *